US006043790A

United States Patent [19]

Derneryd et al.

[11] Patent Number: 6,043,790

[45] Date of Patent: Mar. 28, 2000

[54] INTEGRATED TRANSMIT/RECEIVE ANTENNA WITH ARBITRARY UTILIZATION OF THE ANTENNA APERTURE

[75] Inventors: Anders Derneryd, Hisingsbacka; Lars Looström, Västra Frölunda, both of Sweden

[73] Assignee: Telefonaktiebolaget LM Ericsson, Stockholm, Sweden

[21] Appl. No.: 09/046,214

[22] Filed: Mar. 23, 1998

[30] Foreign Application Priority Data

Mar. 24, 1997 [SE] Sweden ..... 9701079

[51] Int. Cl.[7] ..... H01Q 3/22

[52] U.S. Cl. ..... 343/853; 342/368; 343/778

[58] Field of Search ..... 343/853, 700 MS, 343/702; 342/373

[56] References Cited

U.S. PATENT DOCUMENTS

| | | | |
|---|---|---|---|
| 4,728,960 | 3/1988 | Lo | 343/700 MS |
| 5,132,694 | 7/1992 | Sreenivas | 342/373 |
| 5,220,334 | 6/1993 | Raguenet et al. | 343/700 MS |
| 5,493,305 | 2/1996 | Wooldridge et al. | 342/368 |
| 5,510,803 | 4/1996 | Ishizaka et al. | 343/700 MS |
| 5,532,706 | 7/1996 | Reinhardt et al. | 343/778 |

FOREIGN PATENT DOCUMENTS

| | | |
|---|---|---|
| 0 531 877 | 3/1993 | European Pat. Off. . |
| 0 600 799 | 6/1994 | European Pat. Off. . |
| 0 620 613 | 10/1994 | European Pat. Off. . |
| 0 733 913 | 9/1996 | European Pat. Off. . |
| 2 279 504 | 1/1995 | United Kingdom . |
| 95/34102 | 12/1995 | WIPO . |
| 97/35360 | 9/1997 | WIPO . |

*Primary Examiner*—Don Wong
*Assistant Examiner*—James Clinger
*Attorney, Agent, or Firm*—Burns, Doane, Swecker & Mathis, L.L.P.

[57] ABSTRACT

An antenna device and system design form a modular common antenna surface having various surface portions for transmission and reception as well as integrated transmission and reception within the same common antenna surface, the various surface portions either forming passive or active arrays for transmission or reception. Additionally superimposed surface portions of the modular common antenna surface constitute individual transmit and receive array portions, respectively, sharing the total aperture, the modular common antenna surface producing at least one polarization plane for transmission and generally two orthogonal polarization planes for reception to achieve polarization diversity for the reception. Further the antenna surface of the device and system according to the invention generally form a microstrip module array containing a number of radiation element for transmission and/or reception, and consist of one or several columns of individual element forming the antenna aperture, the column and/or columns additionally in the preferred arrangement having integrated power amplifiers and/or low noise amplifiers (LNA:s), respectively.

22 Claims, 8 Drawing Sheets

INTEGRATED TRANSMIT/RECEIVE ANTENNA WITH ARBITRARY UTILIZATION OF THE ANTENNA APERTURE

TECHNICAL FIELD

The present invention relates to an antenna device and an antenna system, and more exactly to active transmit/receive array antennas with arbitrary utilization of the aperture in combination with polarization diversity.

BACKGROUND

On the market there are at present to be found several antennas and antenna system designs for the different application fields of radio transmission and reception, for example satellite communications, radar installations or mobile telephone networks. In this context antennas designed for base stations, for example serving mobile or handheld phones, are of particular interest and especially when using a microwave frequency range.

Present base stations with active antennas will usually have separate antennas for transmission and reception. For transmission there is normally one array antenna for each radio frequency channel, the reason for this being that single carrier power amplifiers (SCPA) can be made with a considerably higher efficiency than multi carrier power amplifiers (MCPA) due to the absence of intermodulation effects. Generally two separate array antennas are used for reception of all the different channels within a frequency range for obtaining diversity. The receive array antennas will be separated a number of wavelengths to reduce influence of fading (also referred to as space diversity). FIG. 1 demonstrates a typical antenna configuration for one sector having three carrier frequencies. All the individual array antennas, both for the reception and the transmission, are here presented as having equal size.

A document WO95/34102 discloses array antennas for utilization within a mobile radio communications system. This antenna comprises a microstrip antenna array with a matrix of microstrip patches having at least two columns and two rows. In addition a plurality of amplifiers will be provided wherein each power amplifier for transmission or each low noise amplifier for reception are connected to a different column of microstrip patches. Finally, beamformers are connected to each amplifier for determining the direction and the shape of narrow horizontal antenna lobes generated by the columns of microstrip patches.

Another document U.S. patent application Ser. No. 5,510,803 discloses a dual-polarization planar microwave antenna being based on a layered structure, the antenna having a fixed and unchangable utilization of the aperture. The antenna may be understood as two fixed, superimposed, single-polarized antennas.

A third document EP-A1-0 600 799 discloses an active antenna for variable polarization synthesis. The antenna, intended for radar applications, utilizes a hybrid coupler with a phasing control of one or two bits, which adds a dephasing of 0°, 90° or 180° permitting the synthetization of linear orthogonal polarization or circular polarization. It is presupposed that the antenna by means of switching may be utilized either for transmission or reception.

Still, in this field of applications, there is a desire and a demand to design and implement compact base station antenna devices and systems having a balanced link budget, for instance for mobile communications.

SUMMARY

The large number of prior art antennas for microwave base stations constitute relatively large and, consequently, expensive arrangements. The size of the arrangements could for instance be reduced by means of an appropriate novel way of integrating transmission and reception as well as simultaneously obtaining polarization diversity reception in the same antenna surface.

The present invention discloses a design which forms a modular common antenna surface having various surface portions for transmit and receive signals and thereby integrated transmission and reception within the same common antenna surface, the various surface portions forming active arrays for transmission or for reception. Additionally superimposed surface portions of such a modular common antenna surface constitute individual transmit and receive array portions, respectively, sharing the total aperture, the modular common antenna surface producing at least one polarization state for transmission and generally two orthogonal polarization states for reception to achieve polarization diversity for the reception.

According to further embodiments according to the invention the antenna surface generally forms, e.g. a microstrip module array containing a number of radiation elements for transmission and/or reception, and consists of one or several columns of individual elements forming the antenna aperture, the column and/or columns may have integrated power amplifiers and/or low noise amplifiers (LNA:s), respectively. The invention being set forth by the dual polarized antenna elements, e.g. crossed dipoles, annular slots, horns etc. can be used besides microstrip antennas.

BRIEF DESCRIPTION OF THE DRAWINGS

The objects, features and advantages of the present invention as mentioned above will become apparent from the description of the invention given in conjunction with the following drawings, wherein.

DETAILED DESCRIPTION

Figure 1:
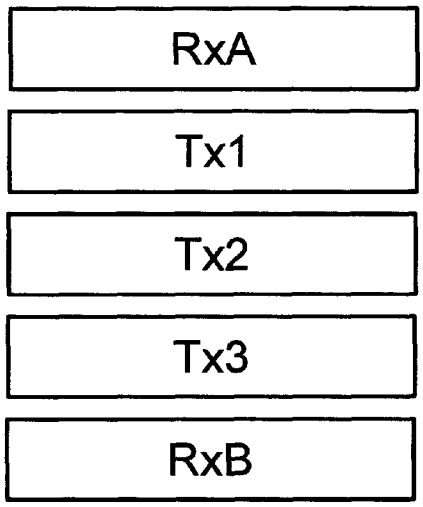
FIG. 1 is an example of a prior art base station active antenna arrangement for three frequency channels.
Figure 2A:
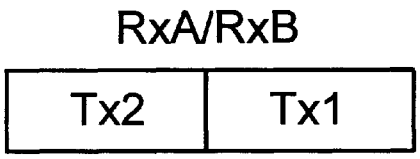
FIGS. 2*a–d* illustrates four alternative configurations for a two frequency channel solution basically embodying the present invention.
Figure 2B:
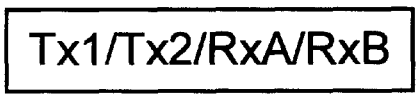
Figure 2C:
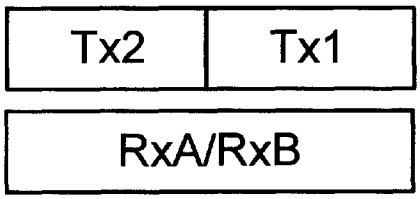
Figure 2D:
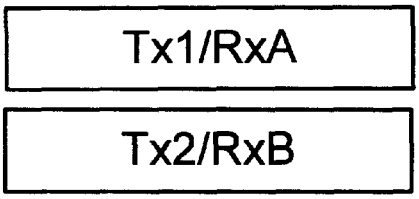

The invention discloses a modular construction of an antenna device and system having integrated transmission and reception within the same or separate antenna surfaces. In FIG. 2 are illustrated four examples of a two frequency channel design for a simple illustration of the basic idea. In all the different examples of FIG. 2 the entire surface of an antenna array column is used for reception, utilizing polarization diversity via signals RxA and RxB, while it may be used as one entire surface portion or be divided into several portions for transmission of each frequency channel, Tx1 and Tx2. In example 2*a* the entire surface of the column is used for RxA and RxB while it is divided into two portions for Tx1 and Tx2, respectively. Example 2*b* illustrates a case where Tx1/Tx2/RxA/RxB share the entire column surface. Example 2*c* illustrates a configuration using two columns whereby a first column is divided into two equal portions for Tx1 and Tx2, while RxA and RxB share the entire surface of a second column. Thus, in some cases the functions are distributed over two antenna surfaces. Consequently the example of FIG. 2*d* illustrates a fourth variant in which Tx1/RxA share the entire first column and Tx2/RxB share the second column. Consequently, this way of constructing is very flexible and the budget for up-and downlink may separately be optimized and balanced.

Transmission takes place with at least one polarization state, but reception always takes place with two polarization states. Many dual polarized antenna elements can be used, but an antenna type being very suitable in this context is the microstrip antenna. Examples of radiation elements having more than one polarization state for transmission (90 degrees or 45 degrees) and for reception (90 degrees and 0 degrees or +45 degrees and −45 degrees) are presented in FIG. 3.

Figures 3A, 3B:
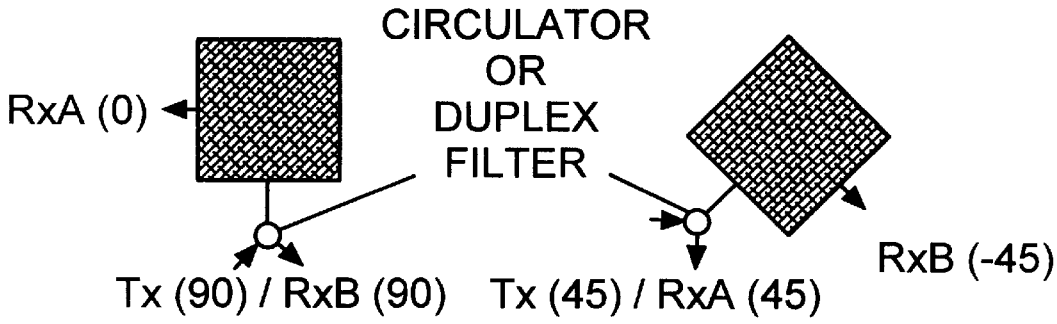
FIGS. 3*a–e* illustrates examples of embodiments utilizing radiation elements in microstrip technique having integrated transmission and reception.

FIG. 3 illustrates a number of different element configurations for use with microstrip antenna arrays. FIG. 3*a* shows a configuration in which the antenna surface of the microstrip module will produce one set of receive signals RxA with a polarization state 0° and another set of receive signals RxB with a polarization state 90°. Additionally a transmit signal of a polarization 90° is fed by means of a circulator or duplex filter which also then outputs the RxB receive signals. In a similar way FIG. 3*b* illustrates the configuration with a transmit polarization of 45 degrees and receive signals at a polarization of +45 or −45 degrees for the receive polarization diversity.

Figures 3C, 3D:
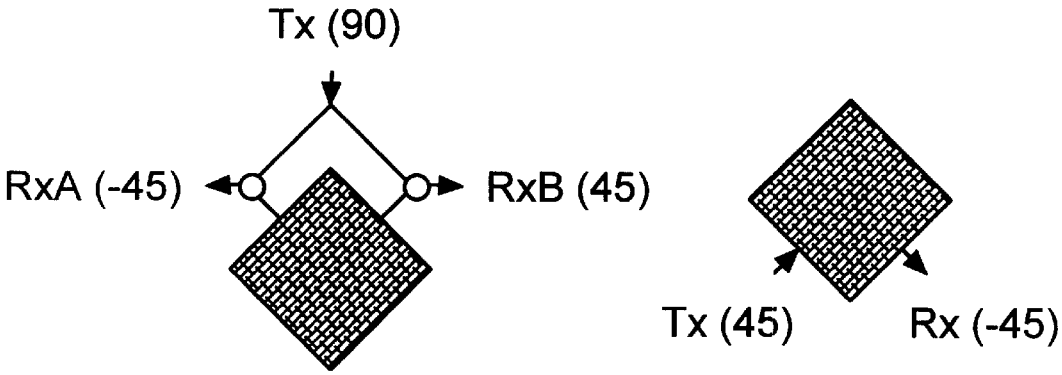
Figure 3E:
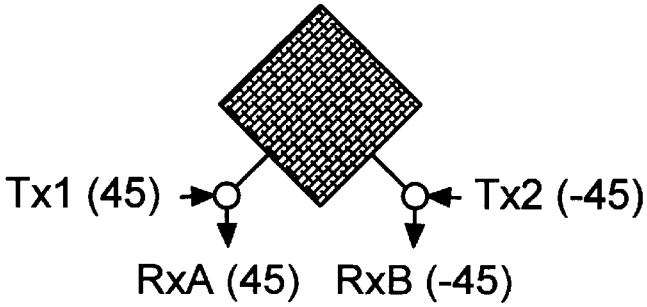

FIG. 3*c* illustrates a further configuration with a corresponding microstrip module (element) for transmit Tx at polarization 90° via two circulators or duplex filters which also output one received polarization 45° for RxA and another received polarization −45° for RxB from the microstrip array module.

FIG. 3*d* illustrates the use of the microstrip module directly for Tx at polarization 45° and Rx at polarization −45°. Finally FIG. 3*e* demonstrates the combination of the microstrip module with two circulators or duplex filters, a first circulator feeding the antenna with Tx1 at polarization 45° and outputting signals RxA received at polarization 45°, and a second circulator feeding the antenna with Tx2 at polarization −45° and outputting signals RxB received at polarization −45°.

In all of the examples shown above linear polarizations are used. However, two orthogonal linear polarizations can be combined in a known manner, e.g. with a 3 dB hybrid, to form two orthogonal circular polarizations. Thus, it is obvious that the invention is not limited to linear polarizations only, but will operate equally well with arbitrary polarization states.

The microstrip module may be either active with amplifier modules distributed in the module or having a central amplifier. The disadvantage of the latter case is that the losses in the antenna distributor or combiner reduce the antenna gain. By placing amplifier modules between the branching network and the antenna elements this is avoided.

Figure 4:
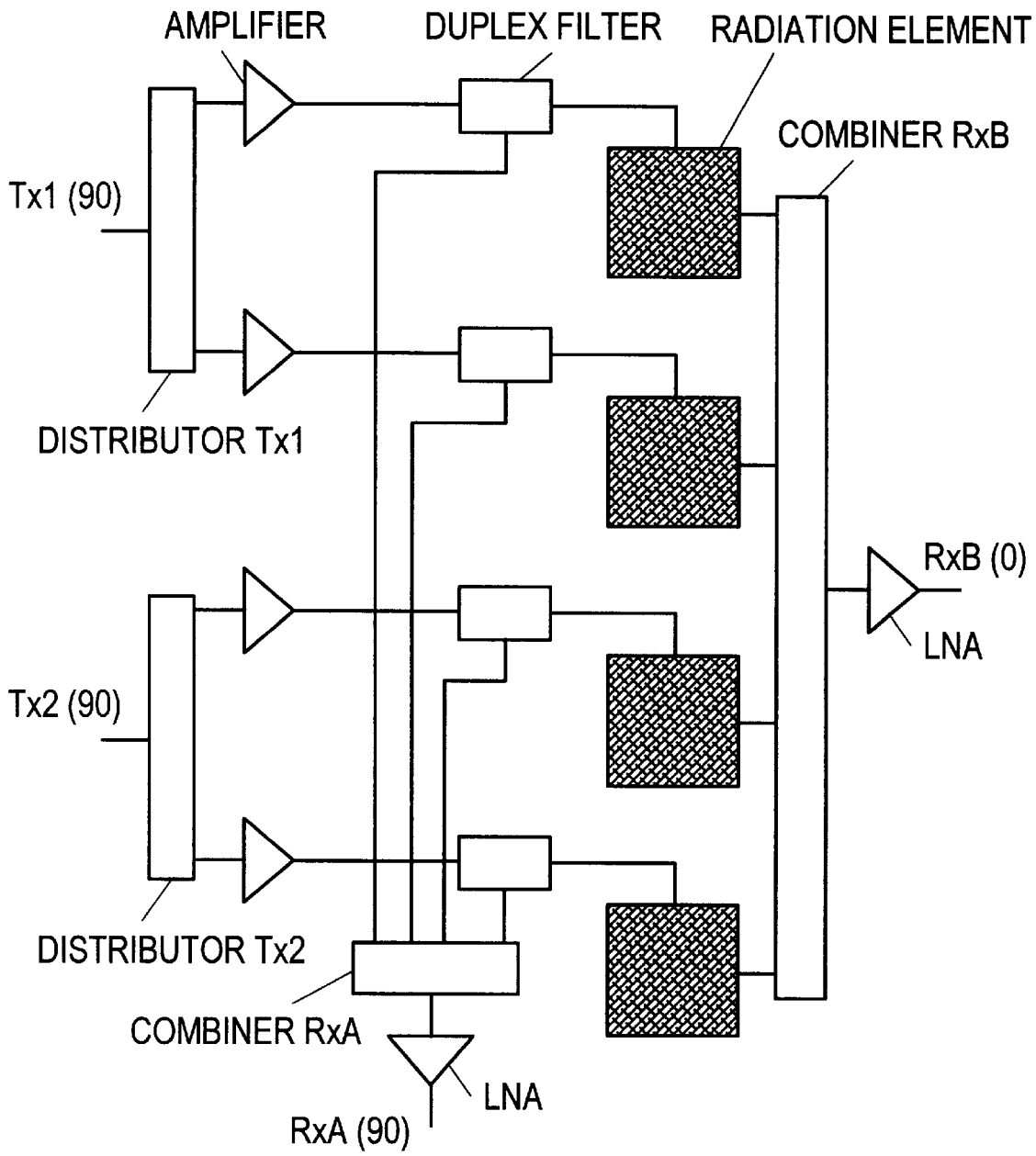
FIG. 4 shows according to the invention an example illustrating an active antenna arrangement having four radiation elements, the radiation elements being divided into two antenna subarrays for transmission.

In FIG. 4 an embodiment is illustrated having a column of four radiation elements and distributed amplifiers for transmission.

The transmission takes place with a polarization of 90° using two different frequency channels, while reception is carried out using polarizations of both 0° and 90°. The two arrays of two radiation elements are fed by means of a distributor for Tx1 and Tx2, respectively, followed by a power amplifier and a duplex filter for each radiation element for the 90° transmit polarization. The four receive outputs for 90° polarization from the duplex filters are combined in a first combiner for RxA followed by a LNA feeding a suitable receiver. The entire column also has four outputs for 0° polarization which are combined in a second combiner for RxB followed by a second LNA outputting the received 0° polarized signals to the receiver.

Figure 5:
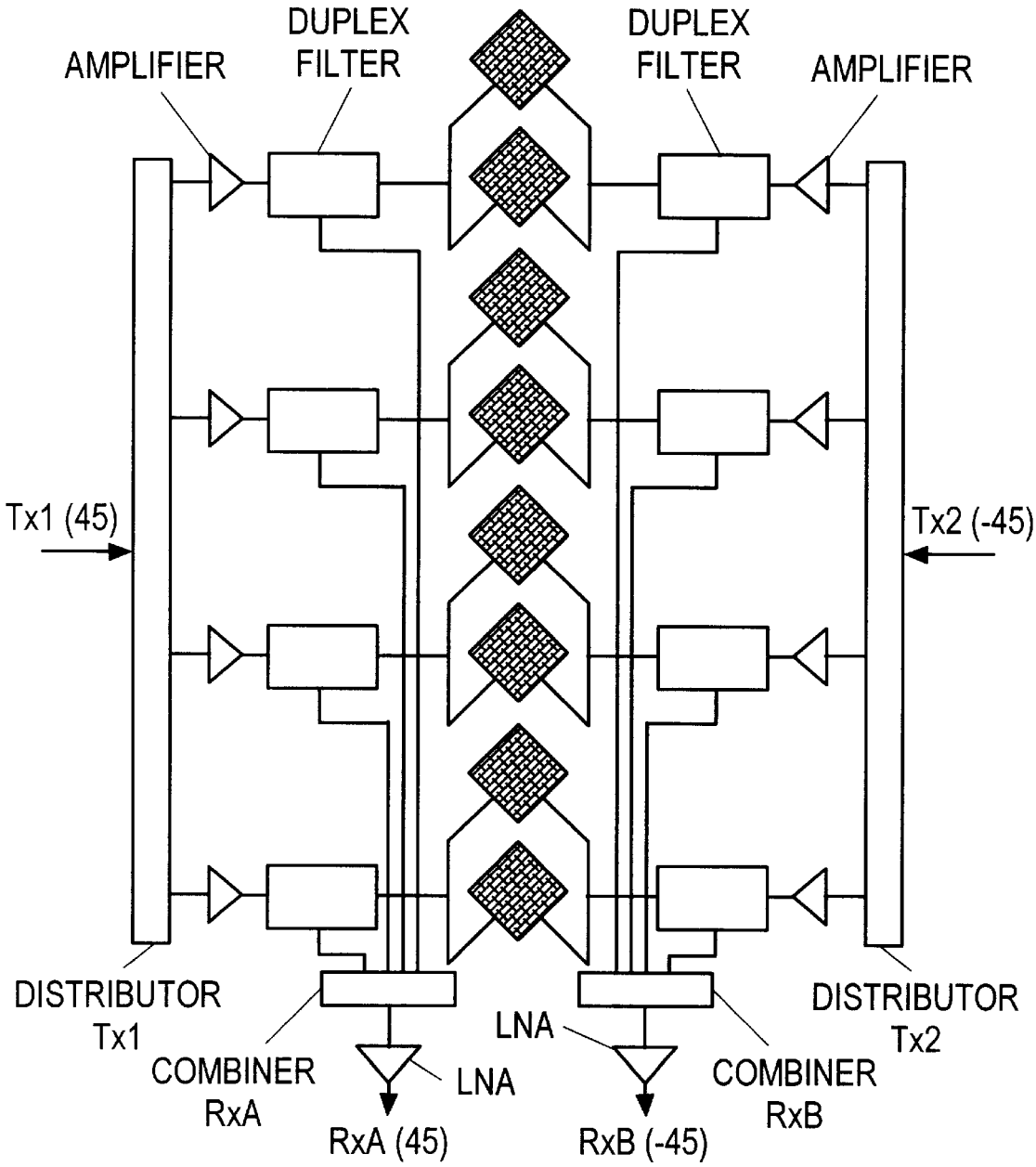
FIG. 5 illustrates according to the invention an active antenna having eight radiation elements and the entire array being used for both transmission and reception.

Another embodiment is demonstrated in FIG. 5 which, according to the present invention, illustrates an active antenna having eight radiation elements in a column. Here the entire array is used both for transmission of two frequency channels as well as corresponding receiving channels. Transmit signal Tx1 at 45° polarization is divided in a first distributor, which via four preferably integrated power amplifiers are feeding a respective two element array of radiation elements over a first group of four corresponding duplex filters. This first group of four duplex filters is also outputting signals to a first combiner used for receive signals RxA and via a first LNA delivering combined signals for polarization 45°. Similarly transmit signal Tx2 at −45° polarization is divided in a second distributor, which via four preferably integrated power amplifiers are feeding the respective two element array of radiation elements over a second group of four corresponding duplex filters. This second group of four duplex filters is also outputting signals to a second combiner used for receive signals RxB and via a second LNA delivering combined signals for polarization −45°. The embodiment of FIG. 5 also corresponds to FIG. 2*b*.

Figure 6:
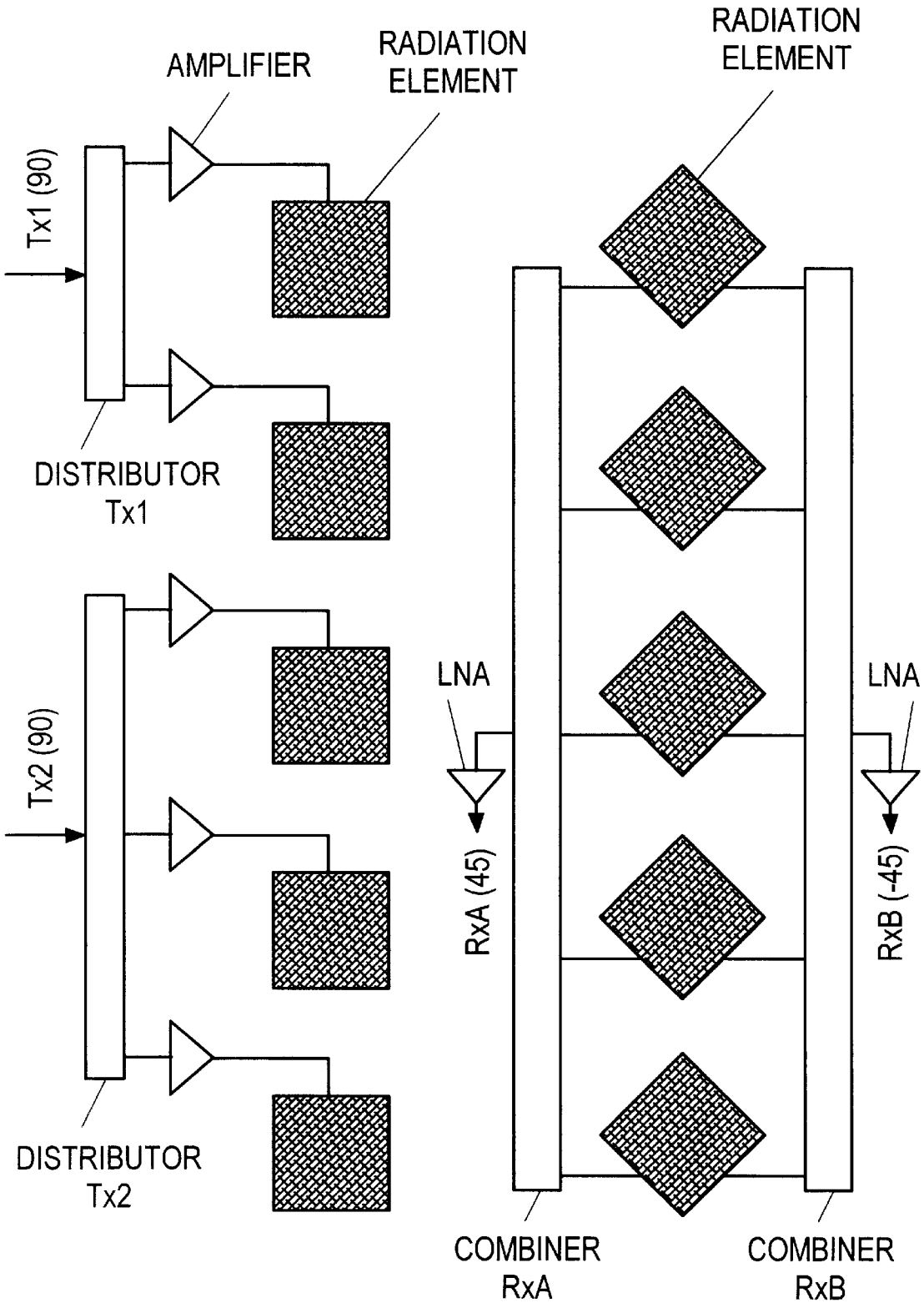
FIG. 6 illustrates according to the invention an active antenna having ten radiation elements, the left column being divided into two transmit antenna subarrays and the entire right column being utilized for polarization diversity reception.

Yet another embodiment of the modular antenna arrangement is demonstrated in FIG. 6 which, according to the present invention, illustrates an active antenna having five radiation elements in two columns. The left column is divided in a first antenna subarray including two radiation elements and a second antenna subarray including three radiation elements. The first and second antenna subarrays are fed by means of a first and second distributor for transmit channels Tx1 and Tx2, respectively. Tx1 and Tx2 represent radiation of a vertical polarization, i.e. 90°. Each one of the radiation elements in the left antenna column is fed by its own, generally integrated, power amplifier. The radiation elements of the right antenna element column are turned 45° to obtain a polarization diversity for reception of +45° for signals RxA and −45° for signals RxB, as previously discussed. RxA is obtained at +45° via a first receiving combiner feeding a first LNA, all preferably being integrated with the antenna structure. Correspondingly RxB is obtained at −45° via a second receiving combiner feeding a second LNA. The embodiment of FIG. 6 also corresponds to FIG. 2*c*.

Figure 7:
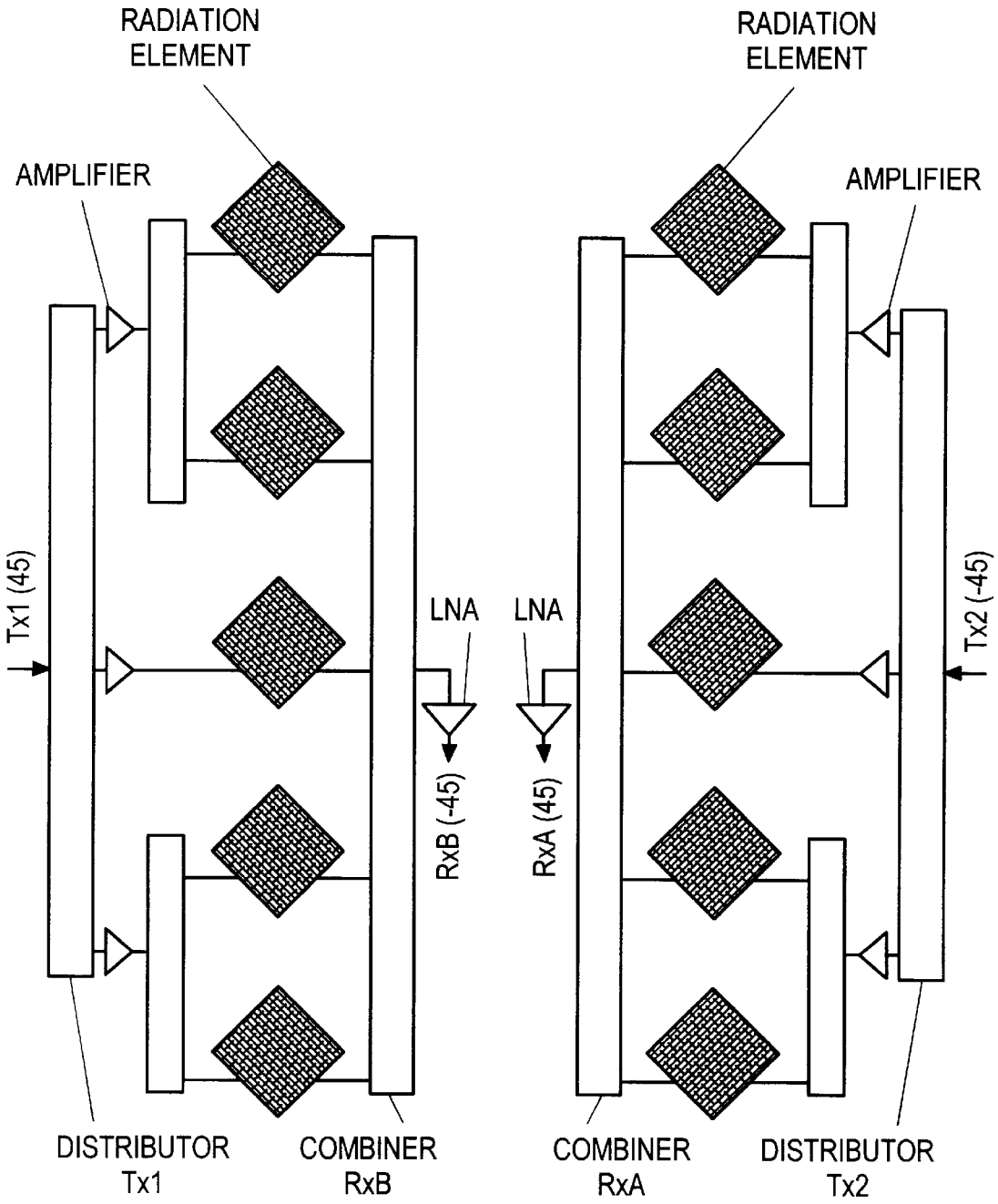
FIG. 7 illustrates according to the invention an active antenna having ten radiation elements in two columns, which both are used for transmission and reception.

An additional embodiment of the modular antenna arrangement is demonstrated in FIG. 7 which, according to the present invention, illustrates an active antenna having five radiation elements in two columns. The embodiment of FIG. 7 corresponds for example to FIG. 2*d*. The left column is divided in a first antenna subarray including two radiation elements, a second antenna subarray including one radiation element, and a third antenna subarray including two radiation elements. The first and third antenna subarrays are fed by means of second and third distributors, which in turn are fed by a first distributor, which also directly feeds the second antenna subgroup consisting of a single radiation element. The left radiation element column is transmitting signal Tx1 at a polarization of +45°. The left antenna column also delivers receive signals RxB of polarization −45° via a five input port combiner having a common LNA at its output port for signals RxB. The right column is configured in an exactly similar manner for producing a transmit signal Tx2 of polarization −45° and receive signals RxA of polarization +45°.

Figure 8:
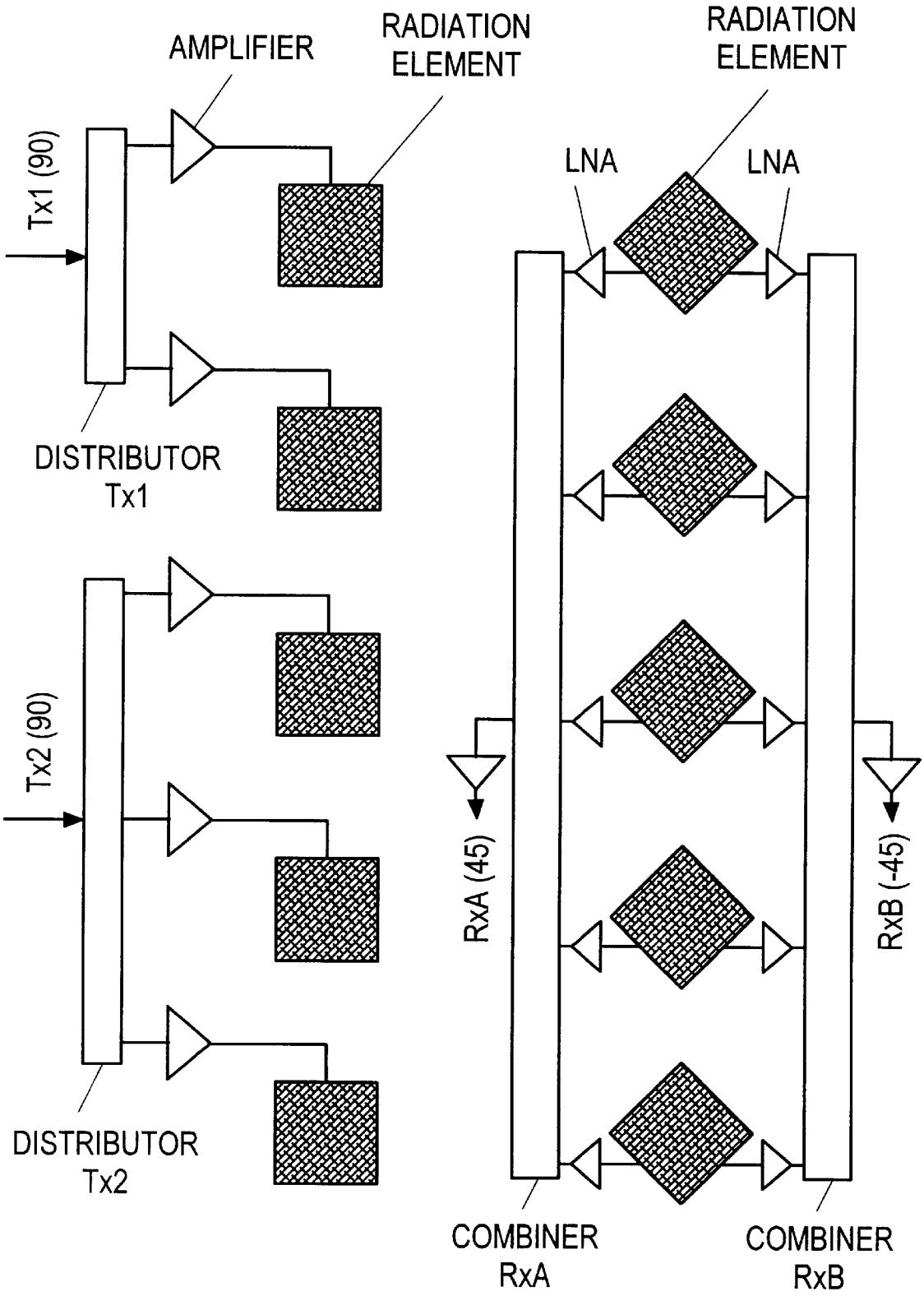
FIG. 8 illustrates according to the invention an active antenna having ten radiation elements in two columns, the left column being divided into two groups for transmission, the entire right column forming one group for reception, both columns having integrated power amplifiers and LNA:s, respectively.

Yet an additional embodiment of the modular antenna arrangement is demonstrated in FIG. 8 which, according to the present invention, illustrates an active antenna having ten radiation elements in two columns. The embodiment of FIG. 8 corresponds for example also to FIG. 2*c* and the embodiment disclosed in FIG. 6. However, in FIG. 8 an example is illustrated having distributed power amplifiers for transmission but also distributed low noise amplifiers (LNA) for reception of the two polarization diversity channels RxA and RxB at polarizations of +45° and −45°, respectively. In other words each of the five antenna elements constituting the right antenna column has its own LNA for the polarization +45° and −45°, respectively. The five LNA:s for the respective receive polarization are combined in a respective first and second combiner in turn outputting the combined RxA or RxB signal.

Figure 9:
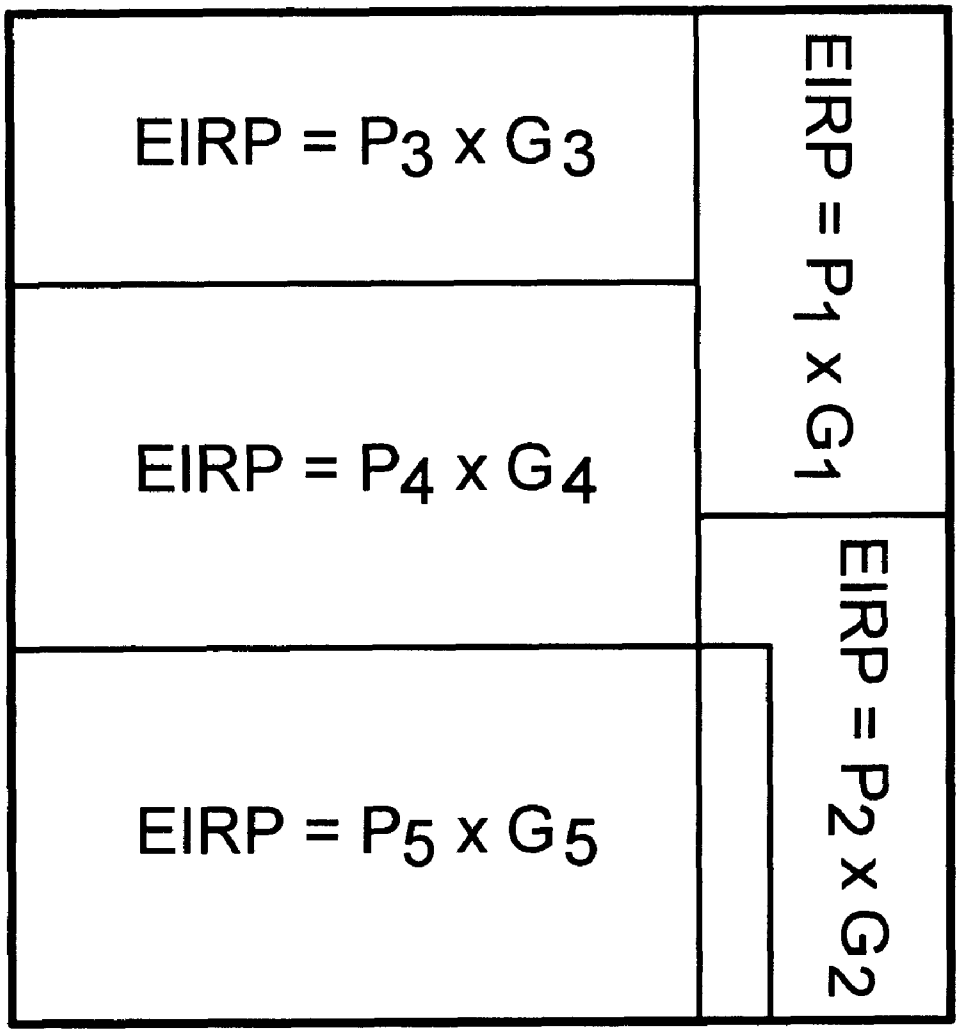
FIG. 9 illustrates according to the invention an antenna configuration for transmission with an arbitrary number of partly overlapping apertures for different frequencies.

Finally, FIG. 9 demonstrates an illustration of an antenna configuration having a number of partly overlapping apertures for different frequencies. In FIG. 9 just only two overlapping transmit surfaces are demonstrated, but the number of overlapping surfaces may according to the invention be arbitrarily chosen. EIRP is defined in FIG. 9 as the product of individual input power $P_x$ and gain $G_x$ for each subarray, where the index x represents a numbering of the respective transmit array surface. As can be seen the two surfaces numbered 2 and 5 are partly overlapping each other. When overlapping apertures are utilized, concerned transmit frequencies must have orthogonal polarizations. Reception will be integrated within the same antenna surface in a similar manner as described above, i.e. the entire antenna surface or portions of the antenna surface will be utilized for the reception of signals in two orthogonal polarization states. Also note that the division of the total antenna surface into transmit subarrays will not necessarily correspond to the division into subarrays for reception, but may comprise a different distribution of the total surface as well as overlapping surfaces.

Furthermore, different configurations of combiners and/or distributors may be used for connecting individual radiation elements or groups of radiation elements in the different embodiments as a method to, for example influence or decrease sidelobes and/or beam direction.

It will be apparent to a person skilled in the art that the distributed amplifiers of the present invention also offers a possibility of, according to the state of the art, applying a variable phase shift of each individual distributed amplifier to thereby steer the radiation lobe in elevation both for transmission and reception (electrical beam tilt). Another advantage in this connection is, that controlling the phase of each amplifier module will imply that it will still be possible to optimize the radiation pattern in a case of failure of an amplifier or in a worst case failure of more amplifiers.

Thus, the advantages of the arrangement according to the present invention are several. A convenient modular build-up will be achieved. Another advantage will be the large flexibility with respect to EIRP, power output, by selection of the number of amplifiers and/or the size of the aperture portion. Also a high transmit efficiency will be obtained due to that the efficiency of the single frequency amplifiers may be utilized without being affected by combination losses as in conventional techniques. There will also be achieved an error tolerant configuration as several amplifiers are used in parallel for one and the same channel. The configuration provides at least one polarization for transmission and especially two orthogonal polarizations for reception for obtaining polarization diversity. Furthermore the arrangement according to the present invention provides selected utilization of the total antenna surface for transmission and reception and integrated transmission and reception within the same antenna surface. All together the arrangement according to the present invention provides a very versatile modular configuration of antenna systems, for instance, for base stations within mobile telecommunications networks.

The invention has been presented by describing a number of illustrative embodiments. In the disclosed embodiments small numbers of individual radiation elements have been shown, but other numbers of radiation elements, power amplifiers, low noise amplifiers as well as distributors and combiners may of course be used. It will be obvious to a person skilled in the art that the versatile modular antenna disclosed may be varied in many ways. Such variations are not to be regarded as a departure from the spirit and scope of the invention, and all such modifications, as would be obvious to one skilled in the art, are intended to be included within the spirit and scope of the following claims.

We claim:

1. An antenna device for a microwave radio communications system generally operating in a microwave frequency range, for forming an antenna arrangement comprising at least one active array antenna, wherein said antenna device utilizes a design forming a modular common antenna surface having various surface portions for transmission and reception as well as integrated transmission and reception within a same total antenna surface of said antenna device, said various surface portions forming active arrays for either transmission or polarization diversity reception, and wherein the antenna's lobe characteristics may be modified bv selectively utilizing portions of the modular surface.

2. The antenna device according to claim 1, wherein superimposed surface portions of said modular common antenna surface constitute transmit array portions and receive array portions, respectively, sharing a total aperture.

3. The antenna device according to claim 2, wherein said antenna device produces at least one polarization state for transmission and two orthogonal polarization states for reception.

4. The antenna device according to claim 1, wherein a polarization of signals transmitted from transmit array portions of said modular common antenna surface is linear in the planes +45° or −45°.

5. The antenna device according to claim 1, wherein a polarization of signals transmitted from transmit array portions of said modular common antenna surface is linear and vertical.

6. The antenna device according to claim 1, wherein single carrier power amplifiers are used in transmit portions of said modular common antenna surface, at least one radiation element in an array surface being fed by one such single carrier power amplifier.

7. The antenna device according to claim 1, wherein low noise amplifiers are used for receiving array portions of said modular common antenna surface, at least one receiving element in an array surface feeding one such low noise amplifier.

8. The antenna device according to claim 6, wherein a total number of single carrier power amplifiers utilized for radiation elements of the modular common antenna surface is selected to optimize EIRP.

9. The antenna device according to claim 6, wherein a total number of single carrier power amplifiers utilized for radiation elements of the modular common antenna surface is selected based on a malfunction tolerance.

10. The antenna device according to claim 7, wherein a total number of low noise power amplifiers utilized for outputting receive signals combined from individual array elements of the modular common antenna surface is selected to optimize receiver sensitivity.

11. The antenna device according to claim 7, wherein a total number of low noise amplifiers utilized for outputting receive signals combined from individual array elements of said modular common antenna surface is selected based on a malfunction tolerance.

12. An antenna system for radio communication generally operating in a microwave frequency range, the system comprising at least one active array antenna, wherein said system utilizes an antenna device design forming a modular common antenna surface having various surface portions for transmission and reception as well as integrated transmission and reception within a same total antenna surface, various surface portions forming active arrays for either transmission or polarization diversity reception, and wherein the antenna's lobe characteristics may be modified by selectively utilizing portions of the modular surface.

13. The antenna system according to claim 12, wherein superimposed surface portions of said modular common antenna surface constitute transmit array portions and receive array portions, respectively, sharing a total aperture.

14. The antenna system according to claim 13, wherein said antenna system produces at least one polarization state for transmission and two orthogonal polarization states for reception.

15. The antenna system according to claim 12, wherein a polarization of signals transmitted from transmit array portions of said modular common antenna surface is linear in the planes +45° or −45°.

16. The antenna system according to claim 12, wherein a polarization of signals transmitted from transmit array portions of said modular common antenna surface is linear and vertical.

17. The antenna system according to claim 12, wherein single carrier power amplifiers are used in transmit portions of said modular common antenna surface, at least one radiation element in an array surface being fed by one such single carrier power amplifier.

18. The antenna system according to claim 12, wherein low noise amplifiers are used in receiving portions of said modular common antenna surface, at least one receiving element in an array surface feeding one such low noise amplifier.

19. The antenna system according to claim 17, wherein a total number of single carrier power amplifiers utilized for the radiating elements of said modular common antenna surface is selected to optimize EIRP.

20. The antenna system according to claim 17, wherein a total number of single carrier power amplifier utilized for the radiating elements of said modular common antenna surface is selected based on a malfinction tolerance.

21. The antenna system according to claim 18, wherein a total number single frequency low noise amplifiers utilized for outputting receive signals combined from individual array elements of said modular common antenna surface is selected to optimize receiver sensitivity.

22. The antenna system according to claim 18, wherein a total number single frequency low noise amplifiers utilized for outputting receive signals combined from individual array elements of said modular common antenna surface is selected based on a malfunction tolerance.

* * * * *